United States Patent [19]

Farrall et al.

[11] Patent Number: 4,695,688

[45] Date of Patent: Sep. 22, 1987

[54] ELECTRICAL CONTACT CONSTRUCTION

[75] Inventors: George A. Farrall, Rexford, N.Y.; Raymond K. Seymour, Plainville, Conn.

[73] Assignee: General Electric Company, Schenectady, N.Y.

[21] Appl. No.: 843,435

[22] Filed: Mar. 24, 1986

[51] Int. Cl.[4] ..... H01H 33/66

[52] U.S. Cl. ..... 200/144 B; 200/270

[58] Field of Search ..... 200/144 B, 270

[56] References Cited

U.S. PATENT DOCUMENTS

| | | | |
|---|---|---|---|
| 2,900,476 | 8/1959 | Reece | 200/144 B |
| 2,949,520 | 8/1960 | Schneider | 200/144 |
| 3,462,572 | 8/1969 | Sofianek | 200/144 |
| 3,522,399 | 7/1970 | Crouch | 200/144 |
| 3,562,466 | 2/1971 | McEligott | 200/270 |
| 3,614,361 | 10/1971 | Weston | 200/270 |
| 3,670,129 | 6/1972 | Cherry et al. | 200/270 |
| 3,727,018 | 4/1973 | Wesoloski et al. | 200/144 B |
| 3,783,213 | 1/1974 | Amoth et al. | 200/144 B |
| 3,852,555 | 12/1974 | Schoucker et al. | 200/144 B |
| 4,109,123 | 8/1978 | Lipperts | 200/144 B |
| 4,392,035 | 7/1983 | Frind et al. | 200/144 B |
| 4,401,869 | 8/1983 | Hrupa | 200/144 B |
| 4,513,268 | 4/1985 | Seymour et al. | 335/35 |

FOREIGN PATENT DOCUMENTS

| | | | |
|---|---|---|---|
| 3327513 | 2/1985 | Fed. Rep. of Germany | 200/144 B |
| 292339 | 7/1965 | Netherlands | 200/144 B |

*Primary Examiner*—Robert S. Macon

*Attorney, Agent, or Firm*—William H. Steinberg; James C. Davis, Jr.; Paul R. Webb, II

[57] ABSTRACT

An electrical contact assembly includes a contact, a contact support integrally connected to a first surface of the contact, and an insert disposed proximate a second, arc-supporting surface of the contact for stabilizing an electrical arc. In one embodiment of the invention the insert comprises an electrically insulating material inset in the arc-supporting surface and forming a metal-insulator boundary therewith. In another embodiment of the invention, the insert comprises a material having a relatively higher electrical resistivity than the contact, and disposed inside the contact so as to leave an integral metal current path from the arc supporting surface of the contact to the contact support, substantially through the center of the contact.

13 Claims, 12 Drawing Figures

90
92
94
10
10
102
98
96

90
94
96
92
102
98
104

120
124
122
130
12
12
126
128

120
124
130
122
126
128
132

ELECTRICAL CONTACT CONSTRUCTION

This invention relates in general to electrical contact assemblies for use in circuit breakers and more specifically to such contact assemblies having inserts for stabilizing electrical arcs.

BACKGROUND OF THE INVENTION

In vacuum circuit interrupters and contactors, for example of the type taught in U.S. Pat. No. 4,109,123 to Lipperts (incorporated herein by reference), the interruption of current typically occurs at the end of the half cycle in which the contacts are separated. When this interruption occurs, the arc current becomes unstable just before the actual sinusoidal zero of current, and drops suddenly to zero. This abrupt drop can cause high voltage transients to be generated in the associated circuit inductance. These transients have a magnitude related to the instantaneous currrent prior to the sinusoidal zero at which instability occurred and can cause electrical breakdown in equipment used in the interrupted circuit. This problem of arc instability in vacuum interrupters has typically been addressed either through the use of surge suppressors, or through the use of a contact material for which the arc is stable to very small currents prior to the natural current zero. The first solution is very expensive. The latter solution compromises operation of the vacuum interrupter in that electrode materials having stable arcing characteristics, typically soft metals with low melting temperatures such as silver, are known to have poor dielectric capabilities. It would thus be desirable to provide a contact assembly for use in a vacuum interrupter which provides the interrupter with both stable arcing characteristics and a high dielectric strength.

In typical air circuit breakers, for example of tthe type taught in U.S. Pat. No. 4,513,268 to Raymond K. Seymour et al. (incorporated herein by reference and assigned to the assignee of the present invention), contacts are constructed of an expensive silver-tungsten alloy. The silver is generally used to provide low contact resistance during switching, and the alloy is used as a sponge to hold molten silver during high level arcing short circuit conditions. In many applications, the size of the contacts must be very large to dissipate heat, and the cost of the contacts becomes prohibitive. However, it is not sufficient merely to cut back on the silver content of the contacts, as the silver provides the low contact resistance. Accordingly, it would be desirable to provide contacts for use in air circuit breakers which provide low contact resistance and are inexpensive to manufacture. It would be further desirable if such contacts acted to stabilize any arc drawn therebetween when the air circuit breakers opened.

The Lipperts patent, cited hereinabove, shows a contact for use in a vacuum interrupter, the contact comprising an internal hollow in the form of a vertically disposed spiral and horizontally disposed cap overlying the spiral, this cap and spiral being filled with an insulating material. It would be desirable to provide a contact assembly for primary use in a vacuum interrupter which provides better arc stabilizing characteristics than that shown in Lipperts. It would be further desirable to provide a contact assembly for primary use in an air circuit breaker which uses inexpensive materials, provides stable arcing conditions, and which does not interfere with the main current flow through the closed contacts as does the cap shown in Lipperts.

OBJECTS OF THE INVENTION

Accordingly, a principle object of the present invention is to provide a new and improved electrical contact assembly for use in both air circuit breakers and vacuum interrupters.

Another object of the present invention is to provide a contact assembly for use in vacuum interrupters, the contact assembly having both stable arcing characteristics and high dielectric strength.

Yet another object of the present invention is to provide a contact assembly for use in air circuit breakers, the contact assembly being inexpensive to manufacture, and exhibiting both a low contact resistance and stable arcing characteristics.

A further object of the present invention is to provide electrical contact assemblies for use in both air circuit breakers and vacuum interrupters which are relatively inexpensive to manufacture.

SUMMARY OF THE INVENTION

New and improved electrical contact assemblies are provided for use in circuit breakers, these electrical contact assemblies using inserts of relatively inexpensive material both to reduce cost and stabilize electrical arcs. Contact assemblies constructed in accordance with the present invention include a metal contact having first and second surfaces. A metal contact support is connected integrally with the first side of the contact. In a first embodiment of the invention for primary use in vacuum interrupters, an electrically insulating insert is inset in the arc conducting second surface of the contact, thereby forming a metal-insulator boundary on this surface. This metal-insulator boundary acts to stabilize the arc on the arc conducting surface, permitting the contact to be constructed from a high dielectric material, such as copper, which would otherwise cause the arc instability described hereinabove.

In another embodiment of the invention for primary use in air circuit breakers, an insert comprising a material having a higher electrical resistivity than the metal contact is disposed inside the contact so as to leave an integral metal current path between the second contact surface and the contact support substantially through the center of the contact. This insert permits typically expensive contact material such as a silver alloy to be replaced with a cheaper material such as a ceramic. The insert acts further to stabilize an arc drawn on a contact surface, while not interfering with the main current path through the contact.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing Figures, in which:

DETAILED DESCRIPTION OF THE INVENTION

Figure 1:
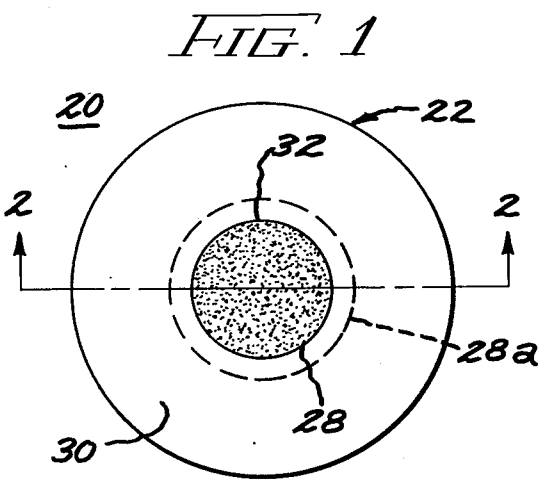
FIG. 1 comprises a top view of an electrical contact assembly constructed in accordance with a first embodiment of the invention.
Figure 2:
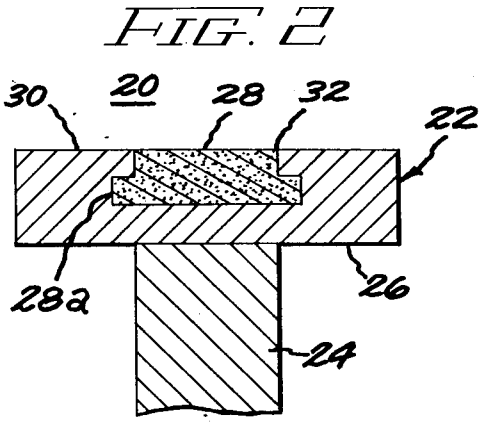
FIG. 2 comprises a sectional view taken along line 2—2 of FIG. 1.

Referring now to FIGS. 1 and 2, an electrical contact assembly 20 is shown comprising a disc shaped metal contact 22. A concentrically disposed metal contact support in the form of a rod 24 is connected integrally with contact 22 at a surface 26 of the contact. This integral contact between contact 22 and rod 24 is formed either by a good electrical connection such as welding or soldering, or by forming the two components as a single piece of metal. A generally disc shaped, electrically insulating insert 28 is inset concentrically in an arc supporting surface 30 of contact 22 and forms an exposed insulator-metal boundary 32 therewith. Insert 28 includes a lip portion 28*a* for secure mounting in electrical contact 22.

For aplication in a vacuum interrupter, contact 22 preferably comprises a metal having a high dielectric strength, for example copper. For application in an air circuit breaker, contact 22 preferably comprises a softer metal with a low melting temperature, for example a silver alloy such as silver-tungsten, silver-molybdenum, silver-nickel or silver-graphite. In either application, insert 28 preferably comprises an electrical insulator, for example a ceramic and rod 24 preferably comprises a conductive metal, for example copper.

In operation, when electrical contact assembly 10 is used in an air circuit breaker or a vacuum interrupter, any electrical arc generated on surface 30 of contact 22 will tend to stabilize at the exposed insulator-metal boundary 32 between contact surface 30 and insert 28. When used in a vacuum interrupter and constructed of the appropriate materials described above, contact assembly 20 will provide excellent dielectric strength and stable arcing characteristics. When used in an air circuit breaker and constructed of the appropriate materials described hereinabove, above, contact assembly 20 accommodates the substitution of a low cost ceramic for the expensive silver alloy while providing stable arcing characteristics. An environment in which electrical contact assembly 20 experiences continuous arcing may cause a metal film (not shown) to be deposited oer the exposed surface of insert 28. This film will have a further stabilizing effect on subsequent arcs, allowing these arcs to burn on a metallic layer without attendant heat losses to the bulk of insert 28.

Figure 3:
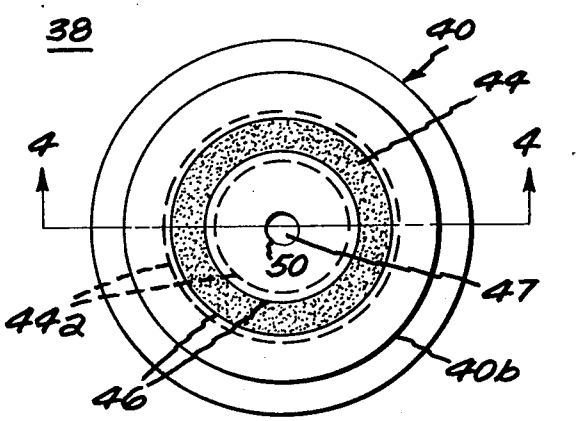
FIG. 3 comprises a top view of an electrical contact assembly constructed in accordance with a second embodiment of the invention.
Figure 4:
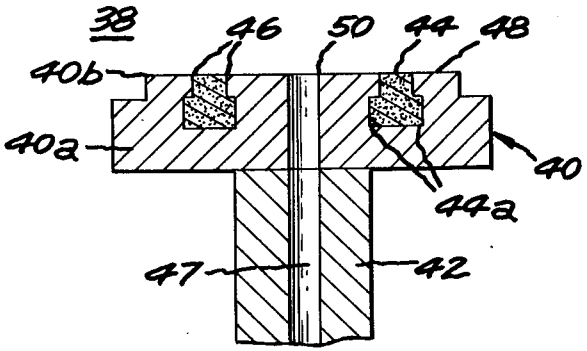
FIG. 4 comprises a sectional view taken along line 4—4 of FIG. 3.

FIGS. 3 and 4 show a second embodiment of the invention including a contact assembly 38 comprising a contact 40, contact support 42 and insert 44. Electrical contact assembly 38 is substantially identical in structure to electrical contact assembly 20 (FIGS. 1 and 2), with the exception of the shape of insert 44, and the inclusion of an optional cylindrical passageway 47 extending coaxially through contact support 42 and contact 40. Insert 44 is in the shape of a doughnut, and disposed concentrically with contact 40 and contact rod 42. Insert 44 includes two lip portions 44*a* for stabilizing its position in contact 40, and two metal-insulator boundaries 46 on a surface 48 of contact 40. Passageway 47 terminates in an aperture 50 disposed concentrically on surface 48 of contact 40. Contact 40 further includes an optional lip portion 40*a* disposed about its other circumference for forming an edge 40*b* to further stabilize an electrical arc. Contact assembly 38 is preferably constructed of those materials described with respect to FIGS. 1 and 2 above.

The operation of electrical contact assembly 38 is substantially identical to that of contact 20 (FIGS. 1 and 2). Electrical contact assembly 38, however, provides two metal-insulator boundaries 46 at which an electrical arc can stabilize. The metal edges situated on surface 48 at aperture 50 and at edge 40*b* provide further areas at which an electrical arc can stabilize. Passageway 47 functions to better disperse an arc in a manner well known to those skilled in the art.

Figure 5:
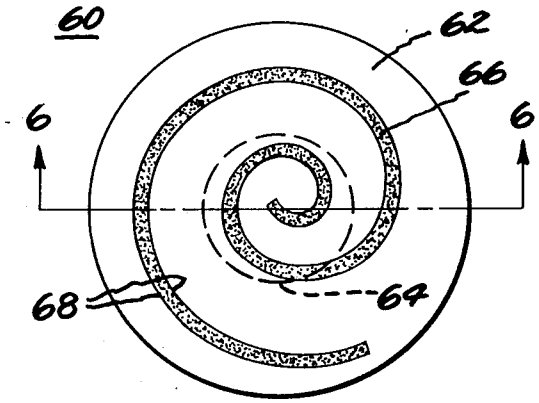
FIG. 5 comprises a top view of an electrical contact assembly constructed in accordance with a third embodiment of the invention.
Figure 6:
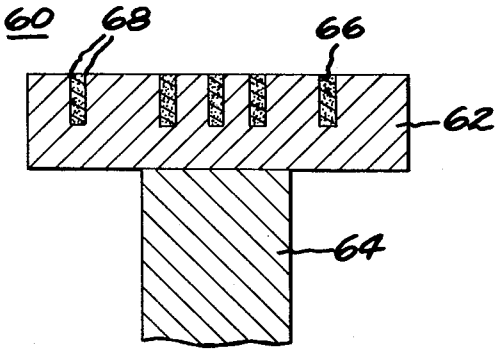
FIG. 6 comprises a sectional view taken along line 6—6 of FIG. 5.

FIGS. 5 and 6 show a third embodiment of the invention including an electrical contact assembly 60 comprising a contact 62, a support 64 and an insert 66. Contact assembly 60 is substantially identical in construction to those embodiments of the invention described above, with the exception that insert 66 is in the shape of a spiral originating proximate the center of contact 62 and terminating proximate the circumferential edge thereof. Contact assembly 60 is preferably constructed of those materials described hereinabove. In operation, this spiral shape of insert 66 stabilizes an arc by giving it two metal-insulator boundaries about which to migrate from the center to the edge of contact 62. These two metal-insulator boundaries are indicated at 68.

Figure 7:
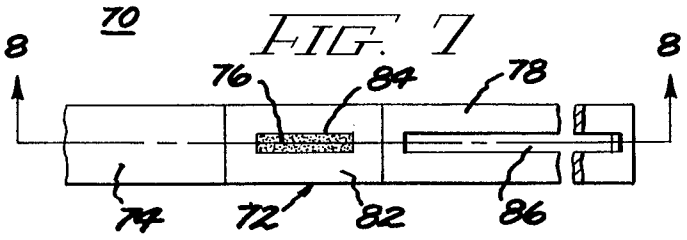
FIG. 7 comprises a top view of an electrical contact assembly constructed in accordance with a fourth embodiment of the invention.
Figure 8:
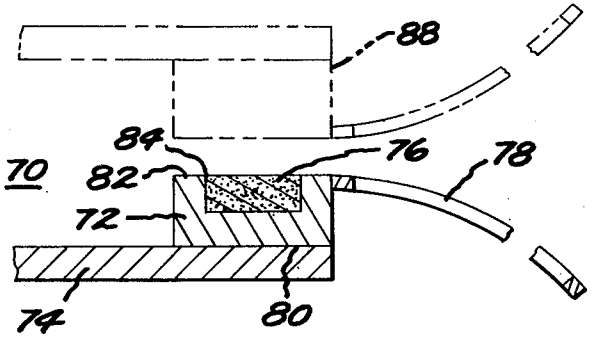
FIG. 8 comprises a sectional view taken along line 8—8 of FIG. 7.

FIGS. 7 and 8 show a fourth embodiment of the invention including an electrical contact assembly 70 comprising a contact 72, a contact support 74, an insert 76 and an arc runner 78. Contact 72 is generally rectangular in shape, and includes a first surface 80 disposed in integral contact with rectangular, horizontally disposed (from the view of FIG. 8) contact support 74. Insert 78 is generally rectangular in shape, and inset into an arc supporting second surface 82 of contact 72 for forming a metal-insulator boundary 84 therewith. Arc runner 78 preferably comprises a layer of thin copper having a rectangular aperture 86 centrally disposed therein, the arc runner being situated proximate surface 82 of contact 72. The remaining elements of contact assembly 70 preferably comprise those materials described with respect to FIGS. 1 and 2 above. A generally opposing, identical contact assembly is shown in phantom at 88 (FIG. 8), representing a typical arrangement of such contact assemblies in air circuit breakers.

The operation of electrical contact assembly 70 is substantially identical to those embodiments of the invention described hereinabove. In addition to the stabilizing effect metal-insulator boundary 84 has on an arc drawn at surface 82, arc runner 78 further functions, in a manner well known in the art, to permit that arc to be driven away from the surface and along aperture 86. The rectangular shape of contact 72, as well as the inclusion of arc runner 78, is typical of the construction of contact assemblies in air circuit breakers. However, it will be appreciated by those skilled in the art that the shape of contact 72 is not so limited and can comprise, for example, a disc shape similar to contact 22 (FIGS. 1 and 2).

Figure 9:
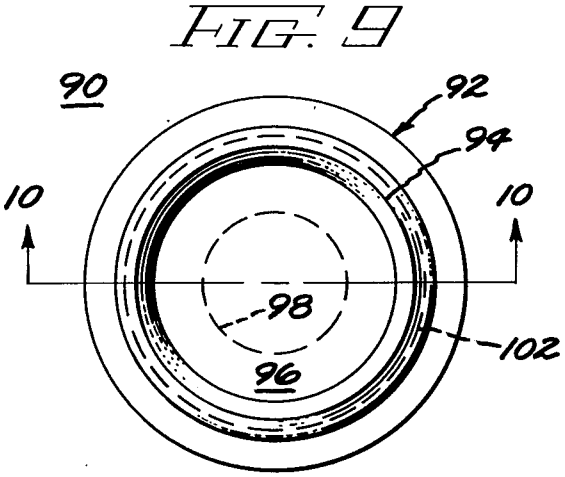
FIG. 9 comprises a top view of an electrical contact assembly constructed in accordance with a fifth embodiment of the invention.
Figure 10:
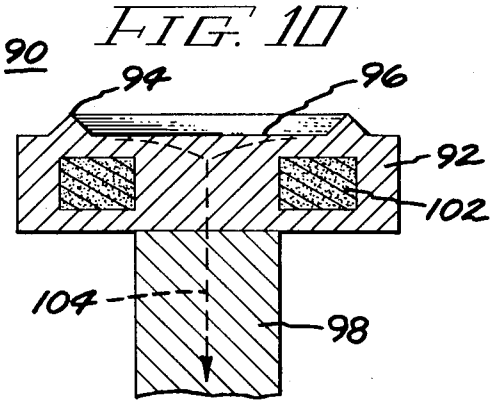
FIG. 10 comprises a sectional view taken along line 10—10 of FIG. 9.

Referring now to FIGS. 9 and 10, a fifth embodiment of the invention is shown wherein an electrical contact assembly 90 comprises a disc shaped metal contact 92 having an optional ridge 94 disposed concentrically on a surface 96 thereof. A metal contact support in the form of a concentrically disposed rod 98 is connected integrally with contact 92 at a second surface 100 thereof. A doughnut shaped insert 102, comprising a material characterized by a higher electrical resistance than the material of electrical contact 92 and rod 98, and capable of withstanding high temperatures in the range of those normally encountered in air circuit breakers and vacuum interrupters, is disposed concentrically inside of contact 92 so as to leave an integral metal path for electrical current between surface 96 and contact rod 98, substantially through the center of contact 90. This current path is indicated as dashed-line 104. Contact 92 and rod 98 preferably comprise those metals described with respect to FIGS. 1 and 2 hereinabove. Insert 102 preferably comprises a ceramic or a high-temperature metal having an electrical resistivity relatively higher than that of contact 92. For example, when contact assembly 90 is used in an air circuit breaker and contact 92 is constructed of a silver alloy, insert 102 preferably comprises tungsten or molybdenum, or a ceramic such as alumina.

The operation of electrical contact assembly 90 is substantially identical to that of the previous embodiments of the invention described hereinabove. Because insert 102 is disposed totally inside of contact 92, its stabilizing effect on an arc at surface 96 is due to the use of a higher resistivity material for insert 102 and will be subtler than those contacts having the exposed, metal-insulator boundary described above. This stabilizing effect is in the form of a magnetic field on surface 96 which causes an arc to stabilize along a circle above insert 102. Ridge 94 enhances this stabilizing affect by providing a metal edge for further stabilizing an electrical arc in this same general area.

Because contact assembly 90 has a buried insert 102 and thus a subtler arc stabilizing affect than those contact assemblies with the exposed metal-insulator boundaries described above, it has particular application in air circuit breakers where unstable arcing is less of a problem. When used in air circuit breakers and constructed of those materials described above, insert 102 has the specific advantage of replacing the bulk of the expensive silver alloy used to construct contact 92 and contact support 98 with a less expensive metal or ceramic material. Further, the positioning of insert 102 is such as to leave an integral metal current path 104 substantially through the center of contact 92, thereby interfering as little as possible with the flow of current through the air breaker.

Figure 11:
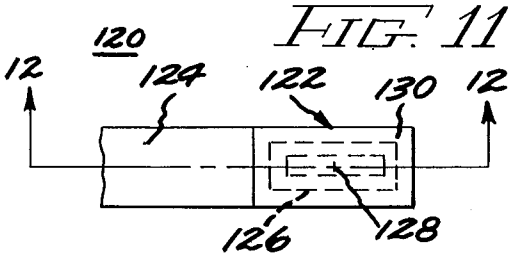
FIG. 11 comprises a top view of an electrical contact assembly constructed in accordance with a sixth embodiment of the invention.
Figure 12:
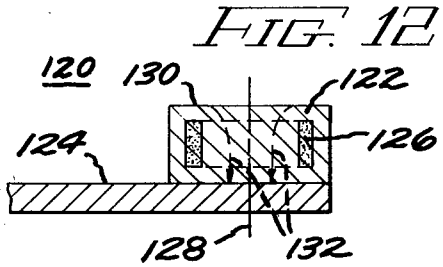
FIG. 12 comprises a sectional view taken along ine 12—12 of FIG. 11.

Referring now to FIGS. 11 and 12, a sixth embodiment of the invention includes an electrical contact assembly 120 comprising a contact 122, a contact support 124 and an insert 126. The construction of contact assembly 120 is substantially identical to that of contact assembly 70 (FIGS. 7 and 8) above, with the exception of the shape of insert 126 and the inclusion of the insert totally within contact 122. In this embodiment of the invention, insert 126 is generally rectangular and includes a hollow disposed generally coaxially with the contact about an axis 128. Because insert 126 is buried in contact 122, contact assembly 120 is particularly suited for use in air circuit breakers and preferably comprises those materials described hereinabove with respect to FIGS. 9 and 10. The operation of contact assembly 120 is substantially identical to that of contact assembly 90 (FIGS. 9 and 10), insert 126 producing a stabilizing affect at an arc supporting surface 130 of contact 122 while replacing contact metal with insert material. Contact assembly 120 further leaves an integral metal current path 132 between arc supporting surface 130 and contact support 124. It will be appreciated by those skilled in the art that a contact runner, similar to contact runner 78 (FIGS. 7 and 8), may be optionally included with electrical contact assembly 120. It will be further appreciated that contact 122 is not limited to the rectangular shape illustrated, but can comprise for example, the disc shape of contact 92 (FIGS. 9 and 10).

There is thus provided multiple embodiments of improved electrical contact assemblies for use both in air circuit breakers and vacuum interrupters, these electrical contact assemblies providing improved stabilization of electrical arcs. When used in air circuit breakers, these electrical contact assemblies provide the additional benefit of substituting inexpensive materials for normally expensive silver alloys. When used in vacuum interrupters, these electrical contact assemblies provide the further advantage of high dielectric strength. It will be appreciated by those skilled in the art that those embodiments of the invention which include an exposed metal-insulator boundary are intended primarily for use in vacuum interrupters where arc stabilization is the most important consideration. Those embodiments of the invention wherein the insert is buried and an integral current path is left substantially through the center of the contact are primarily intended for use in air circuit breakers where material expense and high current flow are primary considerations. However, either type of contact assembly can be used in either type of breaker with the attendant advantages described hereinabove.

While preferred embodiments of the invention have been illustrated and described, it will be clear that the invention is not so limited. Numerous modifications, changes, variations, substitutions and equivalents will occur to those skilled in the art without departing from the spirit and scope of the present invention. Accordingly, it is intended that the invention herein be limited only by the scope of the appended claims.

What is claimed is:

1. An electrical contact assembly for use in a circuit breaker, comprising:

a generally disc shaped metal contact having first and second major surfaces;

a metal contact support connected integrally with said first contact surface; and a disc shaped electrically insulating insert disposed concentrically in said second contact surface forming an insulator-metal boundary therewith at the second contact surface.

2. The electrical contact assembly of claim 1 wherein said insert comprises a ceramic material.

3. The electrical contact assembly of claim 1 wheren said contact support comprises a rod disposed concentrically with said disc.

4. The electrical contact assembly of claim 1 wherein said contact and said contact rod each define a passageway extending coaxially through said electrical contact assembly and terminating in an aperture on said second surface of said disc.

5. An electrical contact assembly for use in a circuit breaker, comprising:

a metal contact having first and second surfaces;

a metal contact support disposed integrally with said first contact surface; and an insert comprising a material characterized by a higher electrical resistivity than said contact disposed completely inside said contact so as to leave an integral metal current path of low resistance between said second contact surface and said contact support substantially through the center of said contact.

6. The electrical contact assembly of claim 5 wherein:

said contact comprises a silver alloy; and said insert comprises a metal or a ceramic.

7. The electrical contact assembly of claim 6 wherein:

said contact is generally disc shaped;

said insert is generally doughnut shaped and disposed concentrically with said contact.

8. The electrical contact assembly of claim 7 and further comprising a circular metal ridge disposed concentrically on said second surface of said contact for stabilizing the rotation of an electrical arc.

9. The electrical contct assembly of claim 6 wherein:

said contact is generally rectangular in shape; and said insert is generally rectangular in shape and defines a hollow center.

10. An electrical contact assembly for use in a circuit breaker, comprising:

a generally disc shaped metal contact having first and second major surfaces;

a metal contact support connected integrally with said first contact surface; and a toroidal shaped electrically insulating insert disposed concentrically in said contact surface forming an insulator-metal boundary therewith at the second contact surface.

11. The electrical contact assembly of claim 10 wherein said insert comprises a ceramic material.

12. An electrical contact assembly for use in a circuit breaker, comprising:

a generally rectangular metal contact having first and second major surfaces;

a metal contact support connected integrally with said first contact surface; and a generally rectangular electrically insulating insert forming an insulator-metal boundary therewith at the second contact surface.

13. The electrical assembly of claim 12 and further including an arc runner attached to said contact proximate said second surface thereof.

* * * * *